United States Patent [19]

Fukumoto et al.

[11] 4,097,679

[45] Jun. 27, 1978

[54] SIDE WALL OF THE ULTRA HIGH POWER ELECTRIC ARC FURNACES FOR STEELMAKING

[75] Inventors: Ichiro Fukumoto, Kanzaki; Susumu Hayashida, Himeji, both of Japan

[73] Assignee: Sankyo Special Steel Co., Ltd., Japan

[21] Appl. No.: 725,289

[22] Filed: Sep. 21, 1976

[30] Foreign Application Priority Data

Jan. 9, 1976 Japan ..... 51/1585

[51] Int. Cl.[2] ..... F27D 1/12

[52] U.S. Cl. ..... 13/32

[58] Field of Search ..... 13/32, 35

[56] References Cited

U.S. PATENT DOCUMENTS

| | | | |
|---|---|---|---|
| 3,829,595 | 8/1974 | Nanjyo et al. | 13/35 X |
| 3,832,478 | 8/1974 | Books | 13/35 |
| 3,843,106 | 10/1974 | Nanjyo et al. | 13/35 X |
| 3,940,552 | 2/1976 | Mizuno | 13/35 |

*Primary Examiner*—R. N. Envall, Jr.

*Attorney, Agent, or Firm*—Toren, McGeady and Stanger

[57] ABSTRACT

A side wall for a UHP electric arc furnace includes water cooled panels positioned within the outer shell of the furnace. The panels form water channels and have multiple fins projecting inwardly from the panel into the furnace. The panels including the fins are formed of pure copper or copper alloy which has a high heat conductivity. The fins have a thickness of at least 10 mm and they project horizontally inwardly toward the furnace for at least 70 mm. The fins are spaced vertically apart in the range of 30–80 mm. The space between the fins is filled with a castable refractory.

4 Claims, 6 Drawing Figures

SIDE WALL OF THE ULTRA HIGH POWER ELECTRIC ARC FURNACES FOR STEELMAKING

BACKGROUND OF THE INVENTION

1. Field of the Invention

This invention relates to strikingly effective side walls for use in ultra high power (UPH) electric arc steel melting furnaces which are exposed to the exceedingly unfavorable thermal conditions, 2. Description of the Prior Art It is well known to use inner coolers in the side walls of electric arc steel melting furnaces for increasing their useful life.

A conventional inner cooler type side wall as shown in FIG. 1, is embedded between the shell and the refractory material lining the side wall as a simple panel of welded steel plates for only the cooling contact areas of the refractory to offset unfavorable thermal conditions. The cooling effect of this inner cooler is not adequate since the contact areas are limited to one surface and a gap is often created between the cooler and refractory material.

Such side walls, if employed in UHP furnaces, will be subjected to early erosion of the refractory material and exposure of the cooler, which may cause its melting and/or cracking of the weldments in the cooler because of furnace heat and/or leakage current with eventual water leakage.

The use of such walls is, therefore, not appropriate in UHP furnaces although some advantages are recognized in regular power funaces.

Another inner cooler as shown in FIG. 2, consists of a heavy walled cast iron block containing water cooling pipes and it is also a well known expedient for cooling side walls. This inner cooler does not necessarily require refractory material on its surfaces facing into the furnace, but uses spontaneously deposited slag on the inwardly facing surfaces as protective layers for the heavy walled cast iron block to reduce heat losses.

This block however lasts only for a limited time and soon becomes useless if exposed to severely heated areas in UHP furnaces due to the following factors.

(1) There is relatively small cooling capacity because of cooling pipes adopted.

(2) The slag is too thinly deposited to work as protective layers.

(3) The deposited slag may be unstable and fall off.

The inventors formerly developed excellent side walls of remarkably long life for use under harsh circumstances as the side walls of UHP furnaces. These side walls overcame the above disadvantages and are the subject of Japanese Patent application No. 49-26223. This prior application features a multi-finned inner cooler installed on the furnace shell with the fins facing inwardly into the furnace so that slag is deposited and adheres to them.

These side walls comprise panels of relatively thin metallic plates for enhancing the cooling effect and they result in a thick, strongly adhering deposited slag, aided also by the attached fins, which can resist the piercing arc heat of the UHP furnaces and reduce heat losses considerably as compared with conventional uncoated coolers. This previous invention had the disadvantage of large heat losses leading to higher power costs, because the uncoated cooling panels even with slag deposited on them had conceivably higher heat conductivity of slag layers than refractories. There was also the possibility of damage to the cooling panels by external forces such as by contact with the scrap.

SUMMARY OF THE INVENTION

This invention presents a side wall construction of nearly permanent life with a small amount of heat loss and resistance to the piercing radiant heat in the UHP furnaces and it also eliminates the disadvantages experienced in the prior patent application mentioned above.

This invention relates to water cooled panels with the multi-fins installed inside the shells of UHP electric steel melting furnaces. The panels are made of pure copper or materials similar to pure copper in high heat conductivity installed inside the furnace shell. For operating effectiveness the fins are at least 10 mm thick and project horizontally for at least 70 mm into the furnace with the fins being spaced in the range of 30–80 mm apart. The spaces between the fins are filled with a castable refractory.

The cooling panels proper and their fins are made of high heat conductivity materials such as copper. The castable refractory filled between the fins is effectively cooled from three to five sides and is supported by the fins. During the early period of use, the side walls, and in particular the bare fin ends, become spontaneously slag coated.

The underlying philosophy of the invention is as follows:

First, there is almost complete prevention of refractory erosion by piercing radiant heat of arc in the UHP furnaces, favorably aided by the heat insulating self adhering slag.

Second, there is practically no damage to the side walls by contact with the scrap.

Third, heat losses are brought down to the level of general refractory material.

The following precautions must be exercised in manufacturing and using the side walls of this invention.

If the thickness of the refractory to be supported (almost equal to the fin length) is set as A, the heat received at the location of this invention (relative heat intensity as compared with that of other areas) as B, spacings between the fins, a thickness of the fins, the number of the reinforcing vertical fins and so forth is set as C, and the quantity of cooling water is set as D, A is a function of the variables B through D.

If the exhaust heat volume is smaller than the intake heat volume of the side walls, the walls become eroded and recede to a certain thinner thickness, reaching a point of equilibrium. A larger exhaust heat volume than the intake heat volume causes undesirably unnecessary heat losses but without side wall erosion problems.

The fin thickness and spacing is determined to balance both exhaust and intake heat volumes at a desired refractory thickness (almost equal to a designed fin length).

The thickness and number of the vertical reinforcing fins are selected, considering how securely the refractory is to be kept in place even when the fins become softened and provide a supporting force.

Accordingly, in applying the side wall construction of this invention to actual use, the design, particularly of the fin thickness and spacing, must be made individually for each fin according to its location i.e., its intake heat volume to maintain a constant thickness along the entire circumference of the side walls throughout a long period of operation.

The requirement for a fin thickness of at least 10 mm lies in the fact that such a thickness is needed to avoid damage or deformation of the fins by contact with the scrap.

The requirement that fins protrude outwardly at least 70 mm and have a spacing in the range of 30–80 mm stems from the following:

A fin having a protruding length under 70 mm and spacing over 80 mm causes the refractory to fall off, while a fin spacing under 30 mm produces excessive heat losses because of too large cooling effects, accordingly the possibility of excessively long fins outperforming the intended purpose of the side wall protection and the accompanying thick layers of refractory are not provided.

The upper limits of fin thickness and length need not be controlled within a certain ranges in the light of the purpose and effectiveness of this invention. It is however, natural that a construction should be so designed in order to save costs so that minimum required values in dimensions are selected after studying the charge material mix as well as the furnace characteristics.

DESCRIPTION OF THE PREFERRED EMBODIMENT

The present invention will be more clearly understood from the following embodiment in reference to the attached drawings.

BRIEF DESCRIPTION OF THE ATTACHED DRAWINGS

Figure 1:
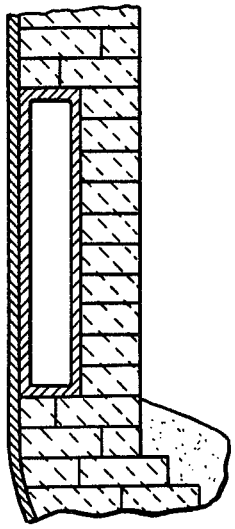
FIG. 1 (PRIOR ART)
FIG. 1 and FIG. 2 represent sectioned side views of furnace side walls incorporating known inner coolers.
Figure 2:
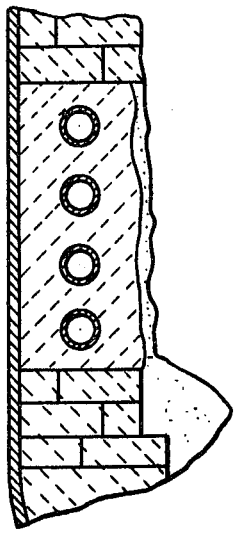
FIG. 2 (PRIOR ART)

Examples of actual side wall construction of this invention shall be cited in the drawings.

Figure 3:
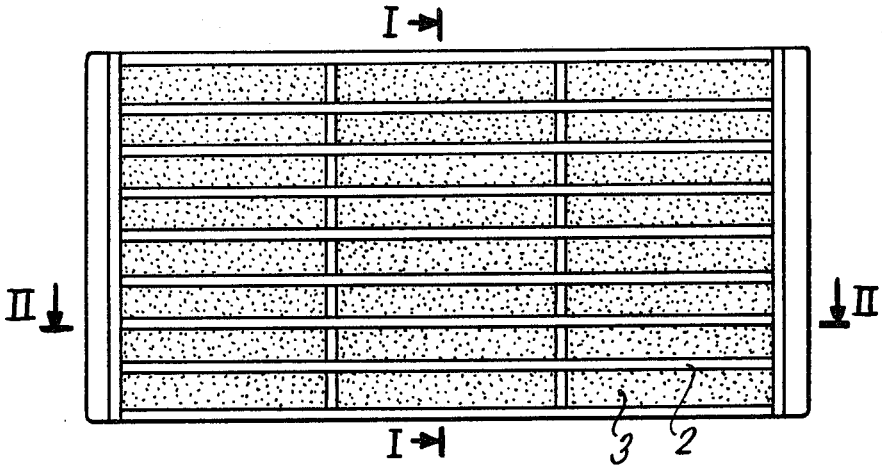
FIG. 3 shows a front view of a side wall embodying the present invention before the wall is exposed to furnace operations.
Figure 4:
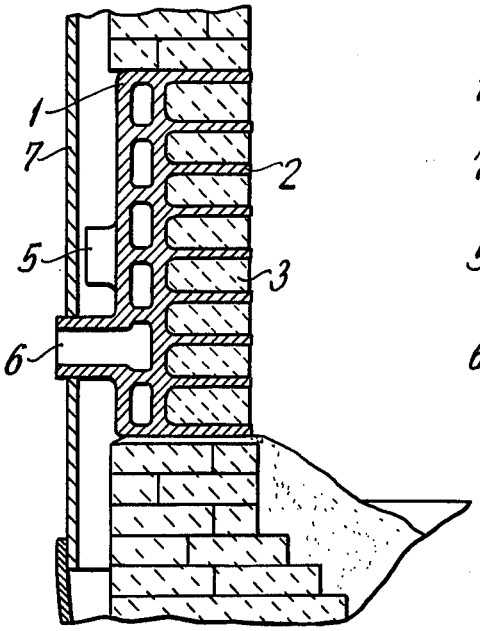
FIG. 4 is a sectioned side view taken along I—I in FIG. 3.
Figure 6:
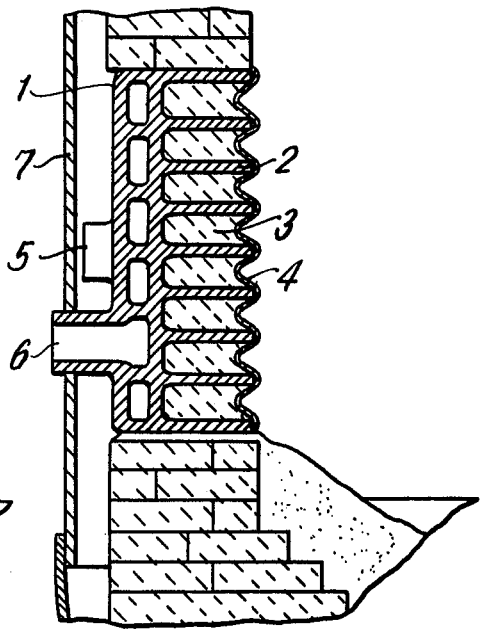
FIG. 6 illustrates a sectioned side view similar to FIG. 4 showing the side wall subsequent to the formation of protective slag layers following the startings of furnace operation.
Figure 5:
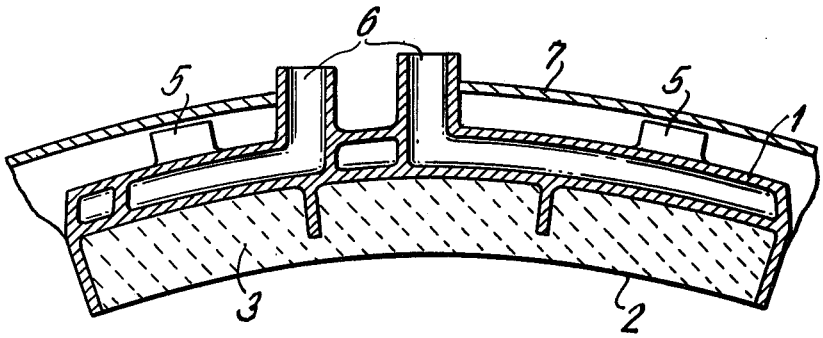
FIG. 5 is a sectioned plan view taken along II—II in FIG. 3.

FIGS. 3 through 6 show the side wall construction of this invention embedded in the side walls in the hot spot of a 60-ton, 50 MVA UHP furnace.

This side wall construction excludes the lower part of the side walls which may come in direct contact with the molten steel.

In FIGS. 3–6, a water cooled panel 1 is shown formed as a pure copper casting, multiple fins 2 are cast together with the panel and a castable refractory 3 is filled between the fins. During furnace operation a protective slag layer 4 is deposited on the inwardly facing surfaces of the fins and the refractory. The panel 1 has a water inlet 5 and a water outlet 6 on its outwardly facing surface and it is enclosed by a furnace shell plate 7. The manner of attaching the cooling panels to the shell plate is deleted not shown, since it is done in the usual manner using fasteners.

In this example, the water cooled panel has a wall thickness of 20 mm, a width of its water running channels of 40 mm, a thickness of the fins 15 mm, a spacing between the fins of 55 mm and a length of the fins 150 mm.

The castable refractory completely fills the spacing between the fins and recedes after one melt to a thickness of 130 mm with the formation of a deposited slag or slag-refractory mixture. The ends of the fins protruding from the refractory remained intact as they are coated with the slag or slag-refractory mixture.

This side wall construction has proved durable to be almost permanently durable with no sizable change in the refractory thickness after tens of melts.

Further in this example, energy losses estimated from a difference of water temperatures at the inlet and outlet was approximately 20,000 Kcal/m$^2$hr amazingly, improved almost to the level of general refractories, from 47,000 Kcal/m$^2$hr measured in the the cooling panels of the previously mentioned patent application.

Although the panels are intended for use only for the hot spots in this example, the rest of the walls can also be embedded with the panels each designed with successful results for a different heat quantity to be received.

As described above, the side wall construction of this invention is extremely effective for the furnace of high melting point metals and particularly of great use under such unusuaully adverse circumstances as in the UHP furnaces.

What is claimed is:

1. A water cooled panel for use as a part of an inside wall within an outer shell in an ultra-high power electric arc furnace, comprising walls forming a panel having a plurality of hollow water channels extending therethrough, said panel having a first side facing toward the outer shell and an oppositely directed second side facing inwardly into the furnace, a water inlet and a water outlet connected to the first side of said panel for flowing water through said water channels, a plurality of fins formed on said second side and extending therefrom inwardly into the furnace, said fins being spaced apart forming multi-sided chambers closed by said second side and said fins and open to the inside of the furnace, a castable refractory deposited into and filling the space within said multi-sided chambers, said fins comprising a plurality of first fins and second fins extending transversely of said first fins, said first fins being at least 10 mm in thickness, said first fins extending horizontally and projecting into the furnace from said second wall for a dimension of at least 70 mm and said first fins being spaced apart in the vertical direction in the range of 30 to 80 mm, and said walls and said fins being formed of one of copper and a copper alloy.

2. A water cooled panel, as set forth in claim 1, wherein said castable refractory being filled into said chambers flush with the inwardly facing edges of said first fins.

3. A water cooled panel, as set forth in claim 1, wherein said fins being formed integrally with said walls of said panel.

4. A water cooled panel, as set forth in claim 1, wherein said second fins extending vertically between said first fins and the inwardly facing edges of said second fins being recessed from the inwardly facing edges of said first fins.

* * * * *

UNITED STATES PATENT OFFICE

CERTIFICATE OF CORRECTION

Patent No. 4,097,679 Dated June 27, 1978

Inventor(s) Ichiro Fukumoto, Susumu Hayashida

It is certified that error appears in the above-identified patent and that said Letters Patent are hereby corrected as shown below:

On the title page:

In the heading of the Patent [73] and [75] should read as follows:

[73] Assignee: Sanyo Special Steel Co., Ltd., Japan

[75] Ichiro Fukumoto, Hyogo-ken;
Susumu Hayashida, Hyogo-ken, both of Japan

Column 2, line 60, before "fins" insert --lateral--;

Column 2, line 61, before "supporting" insert --reduced--

Column 3, line 5, change "outwardly" to --inwardly--

Column 3, line 11, after "effects" change the comma (,) to a period (.); and

UNITED STATES PATENT OFFICE

CERTIFICATE OF CORRECTION

Patent No. 4,097,679 Dated June 27,1978

Inventor(s) ICHIRO FUKUMOTO et al

It is certified that error appears in the above-identified patent and that said Letters Patent are hereby corrected as shown below:

Column 3, lines 11 to 15, delete "accordingly the possibility of excessively long fins outperforming the intended purpose of the side wall protection and the accompanying thick layers of refractory are not provided."

Signed and Sealed this

Fifth Day of April 1983

[SEAL]

Attest:

GERALD J. MOSSINGHOFF

Attesting Officer

Commissioner of Patents and Trademarks